United States Patent [19]

Watterson

[11] Patent Number: 4,477,719

[45] Date of Patent: Oct. 16, 1984

[54] COUNTING BOARD

[76] Inventor: Walter W. Watterson, 31 Vista Ave. Extension, Bradford, Pa. 16701

[21] Appl. No.: 454,532

[22] Filed: Dec. 30, 1982

[51] Int. Cl.[3] ..... A63F 1/18

[52] U.S. Cl. ..... 235/90

[58] Field of Search ..... 235/123, 90; 273/239, 273/281

[56] References Cited

U.S. PATENT DOCUMENTS

| | | | |
|---|---|---|---|
| 245,873 | 8/1881 | Sargent | 235/123 |
| 700,589 | 5/1902 | Webb | 273/239 |
| 990,640 | 4/1911 | Dodge | 235/90 |
| 2,582,874 | 1/1952 | Loeb | 235/90 |
| 2,594,943 | 4/1952 | Logan | 235/90 |
| 2,614,841 | 10/1952 | Joseph | 235/90 X |
| 2,628,776 | 2/1953 | Newman | 235/90 |
| 3,266,724 | 8/1966 | Johnson | 273/281 |
| 3,477,715 | 11/1969 | Nekton | 273/239 X |

*Primary Examiner*—Donald A. Griffin

*Attorney, Agent, or Firm*—Barnes & Thornburg

[57] ABSTRACT

A counting board having a top panel with a series of apertures therein, a plurality of pegs each insertable into one of these apertures and each formed from magnetically attractive material, and at least one strip of magnetic material attached to the top panel or embedded within it. The magnetic strips are aligned with a plurality of apertures so as to maintain the pegs at particular selectively adjustable orientations within their corresponding apertures. Means are also provided for permanently retaining the pegs in the counting board.

6 Claims, 7 Drawing Figures

FIG.1
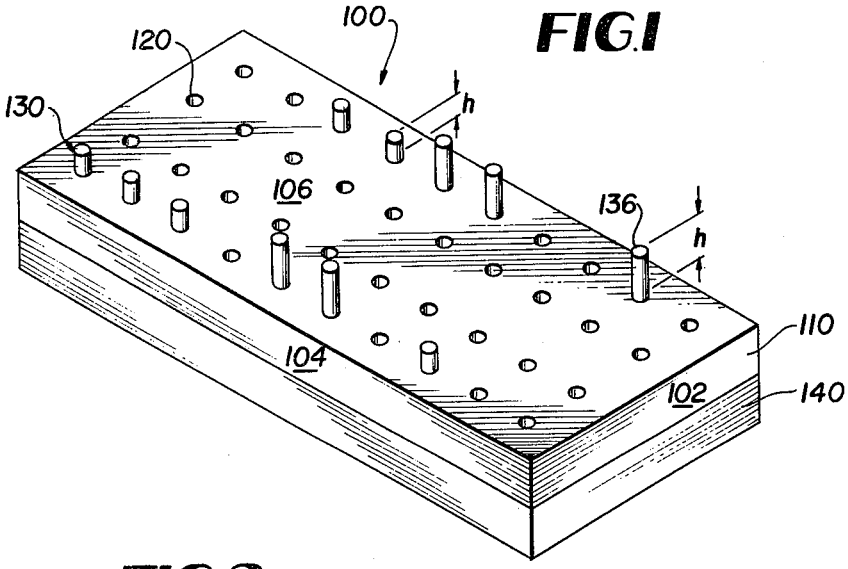
FIG.2
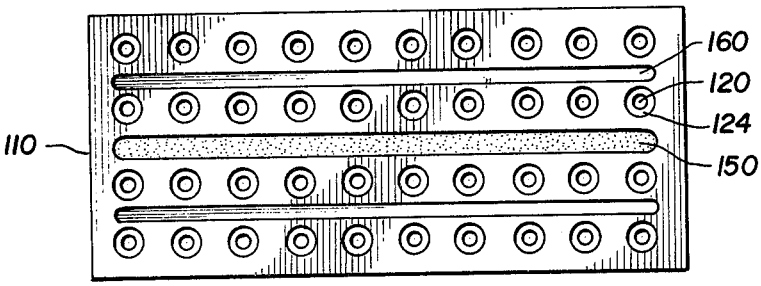
FIG.3
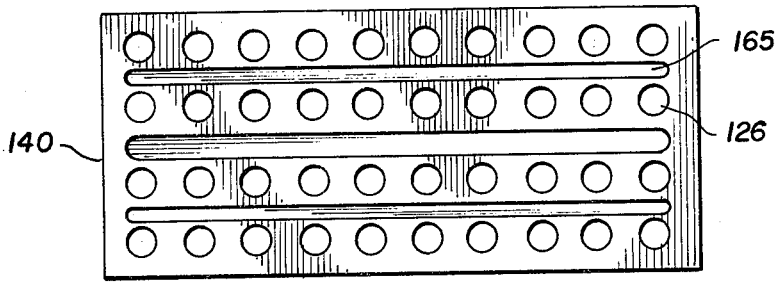
FIG.4a
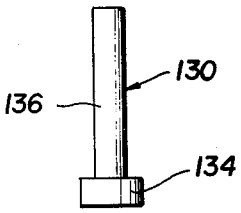
FIG.4b
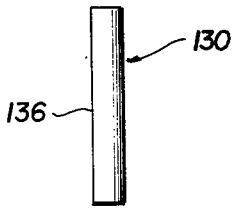
FIG.5
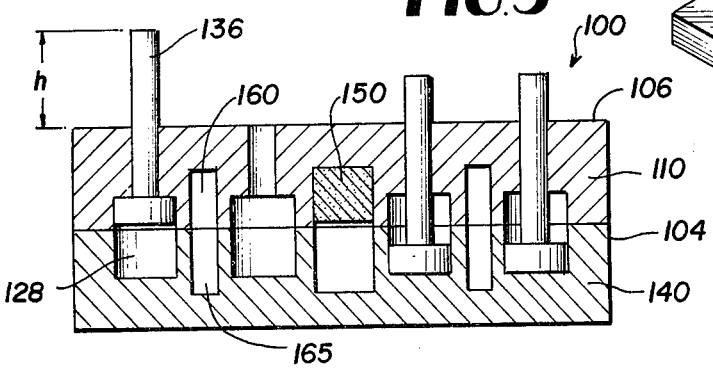
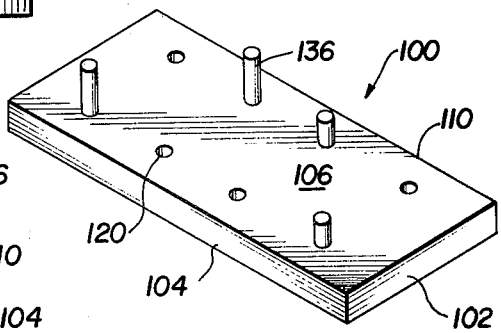
FIG.6

COUNTING BOARD

BACKGROUND OF THE INVENTION

The present invention relates generally to game boards, and more particularly to counting boards, such as cribbage boards. In scoring certain games, such as cribbage, it is not always convenient to use a paper and pen or pencil. Peg board counting means have been used in the prior art, but these have suffered from a number of defects. Pegs, which slidably engage apertures in a board or panel, tend to become lost over a period of time due to their small size and lack of permanent attachment to the counting board. When such pegs are permanently retained within a counting board assembly, counting is usually achieved by raising or lowering each peg to various heights above the surface of the top panel or board. Means for frictionally engaging each peg in each aperture so as to maintain that peg at a particular orientation or height above the surface of the counting board are found in prior art counting boards having both freely seperable and permanently attached counting pegs. However, because of continued sliding contact with the pegs, these frictional maintaining means are worn down relatively quickly, thus rendering the otherwise useful counting board assembly inoperable for its primary function. While much more elaborate peg-maintaining devices may be available, these are usually too expensive and difficult to use in commercially acceptable counting boards.

OBJECTS AND SUMMARY OF THE INVENTION

An object of the present invention is the provision of a counting board having an improved peg engagement means.

Another object of the present invention is to provide a counting board having an improved means of retaining pegs therein during both use and storage and an improved means of maintaining pegs at desired orientations during use.

A further object of the present invention is the provision of a cribbage board wherein counting pegs may be permanently retained within the board assembly and portions thereof may be magnetically maintained at various heights with respect to the upper surface of the top panel.

These and other objects of the present invention are attained in a counting board having a top panel with a series of apertures therein, a plurality of pegs each insertable into one of these apertures and each formed from magnetically attractive material, at least one strip of magnetic material attached to the top panel or embedded within the counting board, and wherein the magnetic strip or strips are aligned with a plurality of apertures so as to maintain the pegs therein at particular selectively adjustable orientations within each of their corresponding apertures. Possible orientations include various heights or elevations which portions of the pegs extend above the upper surface of the top panel. Counting may be achieved by selectively adjusting the orientation of a particular peg or of several pegs.

Other objects, advantages, and novel features of the present invention will become apparent from the following description of the invention when considered in conjunction with the accompanying drawings.

BRIEF DESCRIPTION OF THE DRAWINGS

FIG. 1 shows a perspective view of a counting board in accordance with the present invention.

FIG. 2 shows a bottom view of a counting board top panel according to the present invention.

FIG. 3 shows a top view of a counting board bottom panel according to the present invention.

FIG. 4*a* and 4*b* show cross-sectional views of alternative peg configurations suitable for use in the present invention.

FIG. 5 shows a cross-sectional end view of a counting board in accordance with the present invention.

FIG. 6 shows a perspective view of a counting board in accordance with a modification embraced by the present invention.

DESCRIPTION OF THE PREFERRED EMBODIMENTS

In the accompanying figures, like numbers denote like elements of the present invention.

FIG. 1, which illustrates a preferred embodiment of the present invention, shows a counting board 100 having ends 102, sides 104, and upper surface 106. Counting board 100 may be formed from a top panel 110 secured to a bottom panel 140, although as illustrated in the modification shown in FIG. 6, only a single panel 110 is essential to the present invention. Panels 110 and 140 may be secured together by any suitable means, such as glue, pegs, screws, etc., such securing means not being an essential feature of the present invention.

Top panel 110 contains upper surface 106 and has apertures 120 therein. Apertures 120 may be advantageously arranged in rows or columns for convenience in counting and extend generally parallel to sides 104 if a rectilinear counting board is employed as shown in FIG. 1, but such a configuration is again not essential to the present invention. Pegs 130, formed from magnetically attractive materials, are provided having at least a stem portion 136 thereof which may easily be inserted into and through apertures 120. One peg 130 may be inserted into each of the apertures 120, or fewer pegs 130 may be employed, thus leaving one or more empty apertures, depending upon the particular method of counting used with the counting board. As shown in FIGS. 4*a* and *b*, pegs 130 may have uniform shape over their entire length or may be formed with a widened shoulder 134 and a stem 136 extending therefrom.

As shown in FIG. 2, top panel 110 may be advantageously formed with enlarged bores 124 extending from and beneath apertures 120 on upper surface 106. Bottom panel 104 may be similarly advantageously formed with corresponding enlarged bores 126 such that, when panels 110 and 140 are secured together, chambers 128 are formed therebetween having outlets therefrom by means of apertures 120. As mentioned above, the relative dimensions or widths of pegs 130 and apertures 120 are such that at least a portion of each peg 130 may be easily inserted into and through an aperture 120. Similarly, chambers 128 formed by corresponding enlarged bores 124 and 126, apertures 120, and widened shoulders 134 may advantageously be of such relative dimensions or widths that each of shoulders 134 is insertable into and movable within a chamber 128 and yet is not insertable into the corresponding apertures 120. Pegs 130 may be inserted into counting board 100 within these chambers 128 prior to the securing together of top panel 110 and bottom panel 140 and be movable therein after such securing. Thus, shoulders 134 will serve to permanently retain pegs 130 within counting board 100 while permitting stems 136 to slidably extend through apertures 120 to selected heights above upper surface 106. If however, it is not necessary or desirable in a particular embodiment of the present invention to provide means for permanently retaining pegs 130 within counting board 100, apertures 120 and pegs 130 may be of uniform dimensions throughout their lengths.

At least one strip 150 of magnetic material is attached to top panel 110 by any convenient means. Strips 150 may be advantageously embedded within grooves 160 in top panel 110 and/or grooves 165 in bottom panel 140 when these panels are to be secured together. Each strip 150 is aligned with a plurality of apertures 120 such that magnetic attractive forces are exerted on objects within these apertures. In particular, since pegs 130 are formed from mangetically attractive material, strips 150 will exert attractive forces on the pegs 130 inserted into the apertures 120 associated with these strips.

As illustrated in FIG. 5, the magnetic attractive forces exerted by strips 150 on pegs 130 will be sufficient to maintain pegs 130 at a particular orientation with respect to apertures 120 despite countervailing gravitational and/or normal vibrational forces exerted on pegs 130 by outside sources. In particular, any of stems 136 may be manually pulled or pushed by the user to any selectively adjustable height h above upper surface 106, thus enabling any or all pegs 130 to be "counted" or moved to number-symbollic positions.

The magnetic force exerted by any of strips 150 and the configuration of strips 150 may be selected so as to best suit the particular configuration and use of counting board 100. For example, if only a single strip 150 is to be employed to magnetically influence several rows of pegs 130, it may exert a stronger attractive force than a strip 150 used only to influence a single row of pegs 130. If it is desirable in a particular embodiment of the present invention to have fewer selectable heights h, strips 150 may be made smaller and/or positioned further from upper surface 106. Also, it may be desirable to form pegs 130 and strips 150 such that the primary peg-maintaining forces are exerted through shoulders 134 rather than stems 136. Thus, the number and location of selectable heights or orientations could be adjusted by adjusting the location of strips 150 with respect to shoulders 134 rather than stems 136. The only restriction on magnetic attractive force exertable on pegs 130 by strips 150 is that it not be so strong as to prevent the user from overcoming it to move pegs 130 when counting. In addition, although the means for magnetic attraction employed in the preferred embodiment is shown and discussed above as a strip of material, the present invention specifically contemplates the use of magnetic attraction means of any shape suitable for maintaining peg orientation.

It has been found to be particularly advantageous, although not essential to the present invention, to space apart pegs 130 and magnetic strips 150 within counting board 100 such that no actual physical contact occurs between them directly. This will serve to increase the useful lifetime of both elements and may be readily accomplished by constructing counting board 100 from materials through which magnetic field lines will travel easily.

FIG. 6 shows a modification of the preferred embodiment of the present invention wherein top panel 110 is employed without bottom panel 140 and pegs 130 are not permanently retained by counting board 100. A further modification would permit pegs 130 to extend completely through counting board 100.

From the preceeding description of the preferred embodiments, it is evident that the objects of the present invention have been attained, and although the present invention has been described and illustrated in detail, it is to be clearly understood that the same is by way of illustration and example only and is not to be taken by way of limitation. The spirit and scope of this invention are to be limited only by the terms of the appended claims.

What is claimed is:

1. In a cribbage board having longitudinally spaced rows of peg-receiving apertures formed on a top panel, pegs being inserted into said apertures so as to be selectively adjustable to extend above the upper surface of said top panel by at least two different heights, the improvement comprising:

said pegs being formed from magnetically attractive material and have a shoulder means thereon, said shoulder means having widths greater than the widths of their corresponding peg-receiving apertures;

said top panel having enlarged bores therein each extending from and connected to one of said apertures and said shoulder means have widths less than the widths of their corresponding enlarged bores;

a bottom panel having enlarged bores therein, and being connected to said top panel such that the enlarged bores of each are adjacent and form chambers therebetween capable of slidably receiving said shoulder means; and a magnetic attraction means attached to said cribbage board and aligned with said peg-receiving aperture rows such that said pegs will be maintained by magnetic attractive forces at any of said selectively adjustable heights above said upper surface.

2. In a cribbage board having longitudinally spaced rows of peg-receiving apertures formed on a top panel, pegs being inserted into said apertures so as to be selectively adjustable to extend above the upper surface of said top panel by at least two different heights, the improvement comprising:

said pegs being formed from magnetically attractive material;

a magnetic attraction means attached to said cribbage board and aligned with said peg-receiving aperture rows such that said pegs will be maintained by magnetic attractive forces at any of said selectively adjustable heights above said upper surface; and said top panel being connected to a bottom panel and forms a recess therebetween wherein said magnetic means may be disposed.

3. The cribbage board according to claim 2, wherein said magnetic means is embedded within said top panel below said upper surface thereof.

4. The cribbage board according to claim 2, wherein each of said aperture rows has a magnetic means aligned generally parallel to each side thereof for the entire length of said aperture row.

5. The cribbage board according to claim 2, wherein said top panel has a longitudinal groove therein and said magnetic means is a strip disposed within said groove.

6. The cribbage board according to claim 2, wherein said top panel has a plurality of magnetic means attached thereto and aligned with and spaced between and among said aperture rows.

* * * * *